US005472138A

United States Patent [19]

Ingram

[11] Patent Number: 5,472,138

[45] Date of Patent: Dec. 5, 1995

[54] WRAP-AROUND CARTON WITH IMPROVED LOCKING MEANS

[75] Inventor: Steve Ingram, Woodstock, Ga.

[73] Assignee: Riverwood International Corporation, Atlanta, Ga.

[21] Appl. No.: 416,397

[22] Filed: Apr. 6, 1995

[51] Int. Cl.[6] ..... B65D 5/02

[52] U.S. Cl. ..... 229/198.2; 229/103.2; 493/137; 493/139

[58] Field of Search ..... 229/103.2, 198.2; 206/427; 493/137, 139, 394

[56] References Cited

U.S. PATENT DOCUMENTS

| | | | |
|---|---|---|---|
| 3,356,282 | 12/1967 | Cayne, Sr. | 229/103.2 |
| 4,062,270 | 12/1977 | Culpepper | 493/137 |
| 4,093,116 | 6/1978 | Watkins et al. | 229/198.2 |
| 4,433,806 | 2/1984 | Ganz et al. | 229/198.2 |
| 4,498,618 | 2/1985 | Sutherland | 229/198.2 |
| 4,577,799 | 3/1986 | Oliff | 229/198.2 |
| 4,612,753 | 9/1986 | Taylor et al. | 493/139 |
| 5,004,147 | 4/1991 | Bienaime | 229/103.2 |
| 5,311,994 | 5/1994 | Oliff | 229/198.2 |
| 5,328,080 | 7/1994 | Holley, Jr. | 229/103.2 |
| 5,398,870 | 3/1995 | Bienaime | 229/103.2 |

*Primary Examiner*—Gary E. Elkins

[57] ABSTRACT

A wrap-around carrier capable of being tightly drawn about the packaged articles. Locking tabs on the outer bottom panel flap and locking opening flaps on the inner bottom panel flap are folded back to provide surfaces against which oppositely directed forces can push to move the bottom panel flaps into final partially overlapped condition. The locking tabs include a base locking portion which engages an edge of the locking openings and an outer secondary locking portion which extends through an opening in the inner bottom panel flap.

15 Claims, 3 Drawing Sheets

WRAP-AROUND CARTON WITH IMPROVED LOCKING MEANS

FIELD OF THE INVENTION

This invention relates to mechanical locks for securing two flaps together to form a panel of a carton. More particularly, it relates to the mechanical locks employed in a wrap-around carton.

BACKGROUND OF THE INVENTION

Wrap-around carriers or cartons are commonly used to package beverage containers as well as other types of articles. To form a package the centrally located top panel section of a carrier blank is normally positioned on a group of articles to be packaged and the side panel sections are folded down. Bottom panel flaps at opposite ends of the blank are then folded into place, with one of the flaps partially overlapping the other. Primary locking tabs on one of the flaps are connected to an edge of a primary opening in the other flap, and secondary locking tabs are secured so as to prevent the primary locks from separating. Prior to securing the locks the blank must be tightly drawn about the articles to prevent movement by the articles in the package. This requires the bottom panel flaps to be pulled into final position before the locking tabs can be set into place. Often, the design of the locking mechanism requires this to be accomplished through the use of fingers on the packaging machine which grip and pull the flaps into their final position.

A problem with the type of forming procedure described is that the packaging machines have to be timed and pitched according to the style of carton being run. In other words, the carton tightening fingers must be operated at distance between the center line of adjacent packages, and the speed at which the packages are moving through the machine. Therefore the packaging machine locking device must be reset each time a package is run for articles of different size or configuration.

It would be highly advantageous to be able to run different types of wrap-around cartons on the same packaging machine without having to change the pitch and timing of the locking device on the machine each time. Preferably, the design of the carton panel flaps and the locks themselves should be such that primary and secondary locks are provided.

BRIEF SUMMARY OF THE INVENTION

The invention is directed to a carton formed from a blank having flaps at either end, where one of the flaps partially overlaps and is mechanically attached to the other flap. The mechanical attachment is made by a locking tab on the outer or overlapping flap in cooperation with a locking opening in the inner flap. The locking tab has a base portion which underlies the inner flap of the carton adjacent an edge of the locking opening and an opposite outer portion which extends through a secondary opening in the inner flap. In addition, a flap connected to an edge of the locking opening opposite the first edge at least partially covers the locking opening.

This design allows the locking tab and the locking opening flap to be folded back prior to performing the locking operation. By exerting a force against the folded back locking tab and an oppositely directed force against the folded back locking opening flap the inner and outer panel flaps can be tightly drawn about the articles being packaged and moved into partially overlapping condition. The locking tab can then be inserted into place.

In a preferred arrangement the locking opening flap incorporates a smaller tab, which has a first edge connected by fold line to the locking opening flap and a second edge which contacts the outer portion of the locking tab.

The invention makes it possible to tightly draw a wrap-around carrier blank around the articles to be packaged without having to employ timed finger elements, while at the same time providing effective primary and secondary locks for securely holding the panel flaps in place. These and other aspects and benefits of the invention will readily be apparent from the more detailed description of the preferred embodiment of the invention which follows.

DETAILED DESCRIPTION OF THE PREFERRED EMBODIMENT

Figure 1:
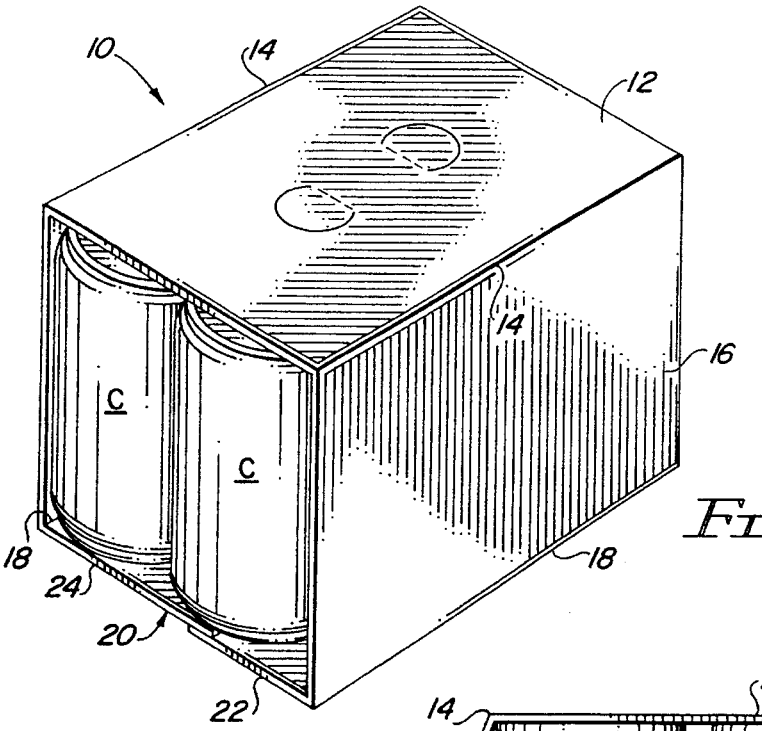
FIG. 1 is a pictorial view of a wrap-around carrier of the type incorporating the locking means of the invention.

Referring to FIG. 1, a wrap-around carrier incorporating the invention and designed to contain six articles is indicated at 10. The carrier is of basic wrap-around design, including a top panel 12 connected by fold lines 14 to side panels 16, which in turn are connected by fold lines 18 to a bottom panel 20. As described in more detail below, the bottom panel is formed from two partially overlapping flaps 22 and 24 which are connected to each other by the mechanical locking means of the invention. The packaged articles are shown for purpose of illustration as comprising two adjacent rows of three beverage cans C, although they could just as well have been represented by any article capable of being contained in a wrap-around carrier.

Figures 2, 4, 6:
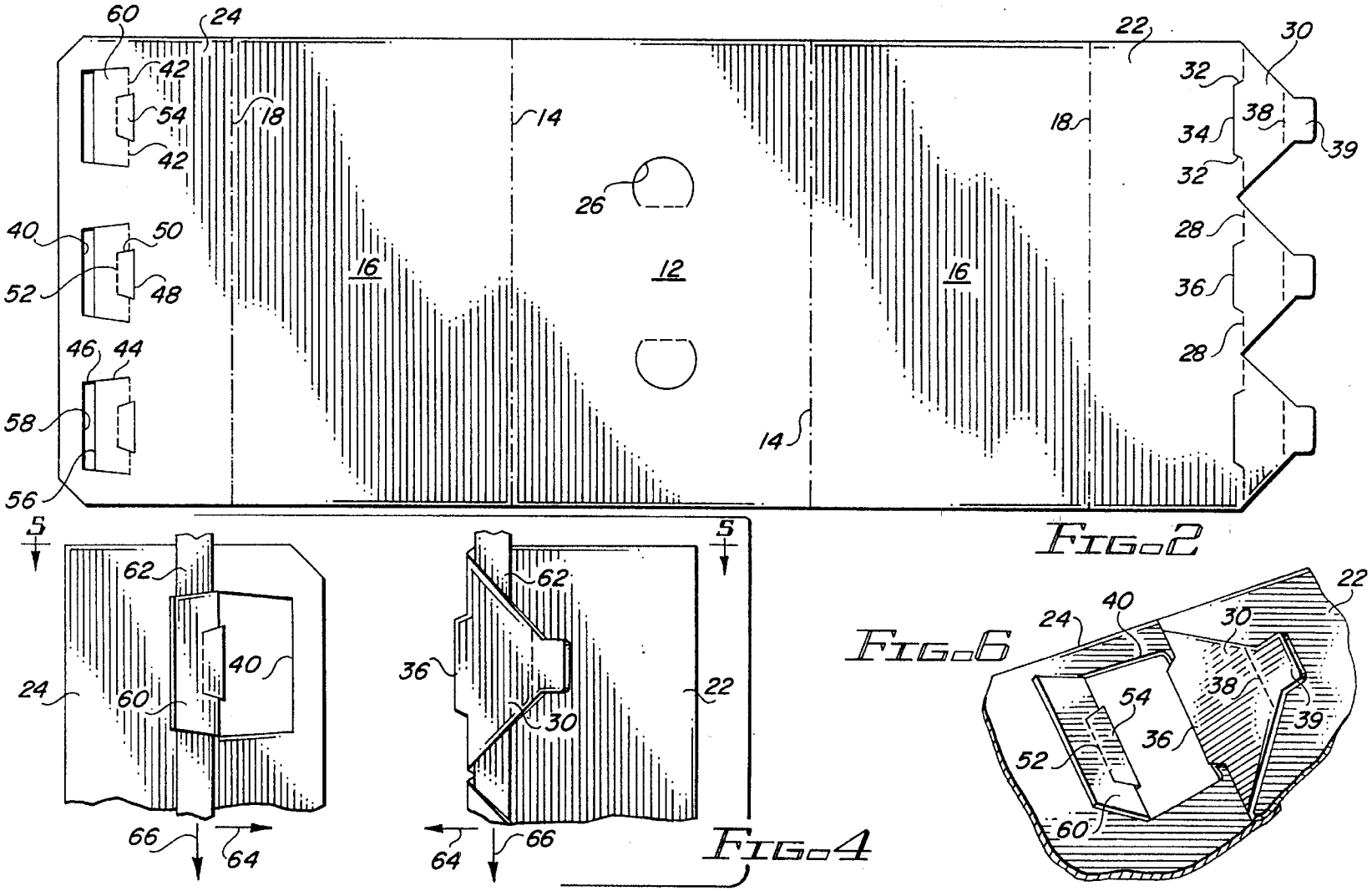
FIG. 2 is a plan view of a blank for forming the carrier of FIG. 1.
FIG. 4 is an enlarged plan view of the underside of the carrier of FIG. 3, omitting the articles being packaged for the sake of clarity, as the partially formed carrier is moving through a packaging machine at a slightly later stage of carrier formation.
FIG. 6 is a partial pictorial view of the bottom panel flaps of the carrier at an initial stage during the forming of one of the bottom panel locks.

A blank for forming the carrier is shown in FIG. 2 as comprising a generally rectangular sheet of flexible material possessing sufficient stiffness and strength to make it capable of withstanding the stresses to which the carrier is subjected during packaging and use. Paperboard of the type normally associated with the carrier industry is preferred. The top panel section 12, which includes finger holes 26, is centrally located in the sheet between the side panel sections 16, and the bottom panel flaps 22 and 24 are connected to opposite side panel sections.

The bottom panel flap 22, which is the outer flap in a carrier formed from the blank, is connected by fold line 28 to three locking tabs 30. The fold line 28 is substantially parallel to the fold line 18, and is interrupted at each locking tab by spaced transverse slits 32. A slit 34, substantially parallel to the fold lines 18 and 28, extends between the ends of the transverse slits 32 and forms with the slits 32 a primary locking tab 36. Each tab 30 functions as a secondary locking tab and includes a fold line 38 substantially parallel to the fold lines 18 and 28 which allows the end portion 39 of the tab 30 to be folded down as explained below.

At the opposite end of the blank the inner bottom panel flap 24 includes three locking openings defined at their outer boundary by cutout edges 40, at their inner boundary by fold lines 42 and at their sides by transverse slits 44 and cutout edges 46. The slits 44 are extensions of the cutout edges 46 and intersect with the ends of the fold line 42. Interrupting the fold line 42 is a slit 48 which is connected by short transverse slits 50 to a fold line 52. The slits 48 and 50 and the fold line 52 form a tab 54. Another edge 56 extends between the ends of the transverse slits 44, forming a cutout 58 defined by the edges 40, 46 and 56. This arrangement creates a flap or tab 60 defined by the fold line 42, the slits 44 and the edge 56. The edge 40 functions as a primary locking edge and the slit 48 functions as a secondary locking slot.

Figure 3:
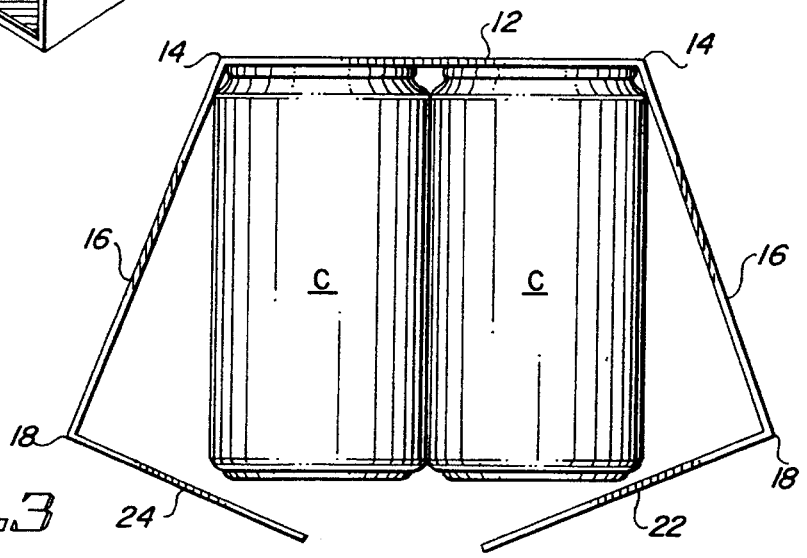
FIG. 3 is an end view of an initial stage during the forming of a carrier from the blank of FIG. 2.
Figure 5:
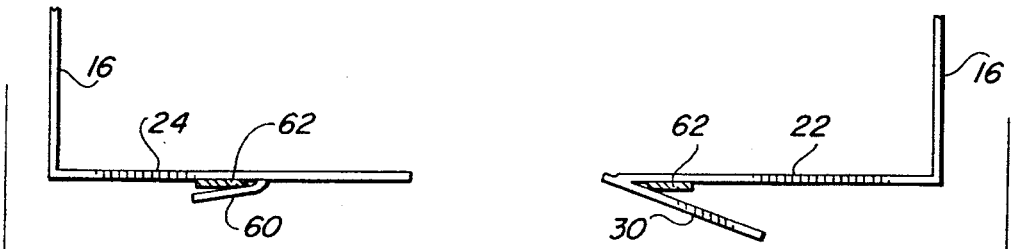
FIG. 5 is a transverse sectional view taken along line 5—5 of FIG. 4, omitting details of the packaging machine except for the-tightening chains described below.

To form a package, the articles are segregated into the desired final arrangement, in this case into two rows of cans of three in each row, and the blank is positioned on top of the cans so that the top panel section rests on top of the cans. The side panel sections and the bottom panel flaps are then folded in as is conventional. A typical point in this folding process is illustrated in FIG. 3. As the inward folding of the bottom panel flaps continues the secondary locking tabs 30 and the flaps 60 are folded back in the reverse direction as illustrated in FIGS. 4 and 5. As previously noted, the cans have been omitted in FIGS. 4 and 5 for the sake of clarity. The folded tabs 30 and flaps 60 provide grips which are used to pull the flaps toward each other to draw the carrier blank more tightly about the articles.

Although the various folding steps and the tightening step can be performed by hand, it is preferred to carry them out by conventional elements of a packaging machine, which are well known in the industry and need no further explanation or illustration. As to the pulling of the bottom panel flaps toward each other, continuous chains 62 of the packaging machine have been shown in FIGS. 4 and 5 to better illustrate a particular benefit of the carton locks. It can be seen that the folded tabs 30 and flaps 60 can now function as pockets or hooks which receive the continuously moving chains 62. These chains are arranged so as to converge slightly, giving them a transverse component of movement, as indicated by the arrows 64, as well as their main component of movement in the machine direction, indicated by the arrows 66. The inward movement of the chains therefore pushes against the folds of the tabs 30 and flaps 60, pulling them and the connected bottom panel flaps 22 and 24 toward each other. Because the movement of the chains is continuous, they need not be timed or adjusted to the particular pitch of the carriers being run in the machine, thereby requiring no adjustment or changeover if it is desired to run a different style of package in the machine.

When the bottom panel flaps have been pulled tightly about the articles the relative positions of a tab 30 and its associated flap 60 are as illustrated in FIG. 6. Both the tab 30 and the flap 60 are still folded back, but the outer bottom panel flap 22 now slightly overlaps the inner bottom panel flap 24, with the primary locking tab 36 being poised over the primary locking edge 40 of the associated opening. The tab 30 is then pivoted up toward its original position to a point where the primary locking tab 36 engages the locking edge 40. The simultaneous folding of the three tabs 30 of the blank is enough to hold the bottom panel flaps together in this position.

Figure 7:
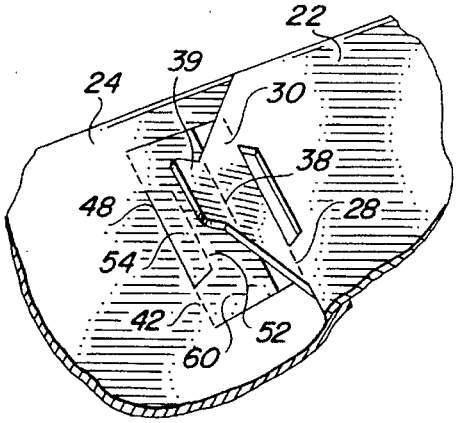
FIG. 7 is a partial pictorial view similar to that of FIG. 6, but showing the locking tabs at a later stage of lock formation.
Figure 8:
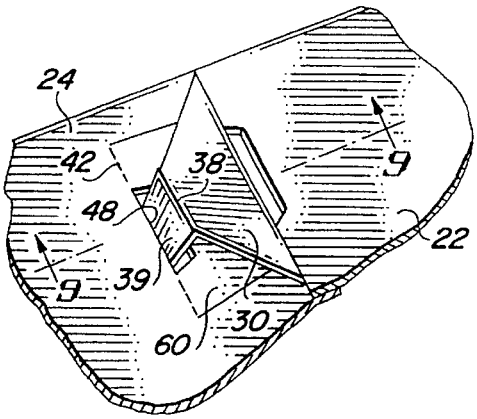
FIG. 8 is a partial pictorial view similar to that of FIG. 7, but showing the locking tabs at a still later stage of lock formation.
Figure 9:
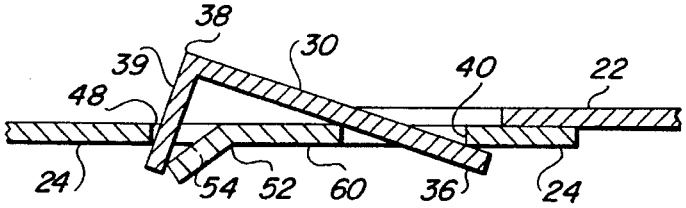
FIG. 9;is an enlarged transverse sectional view taken on line 9—9 of FIG. 8.
Figure 10:
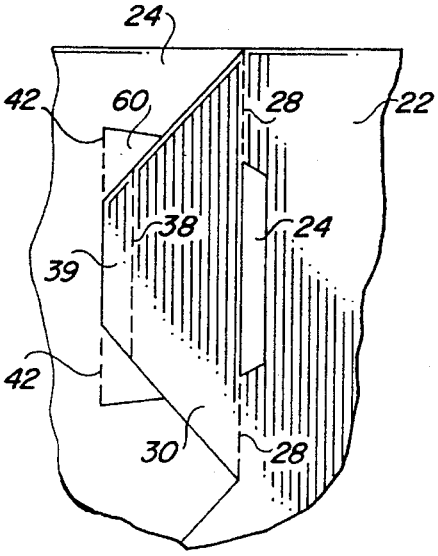
FIG. 10 is a partial plan view of the exterior of the bottom panel of a carrier showing the finished lock.
Figure 11:
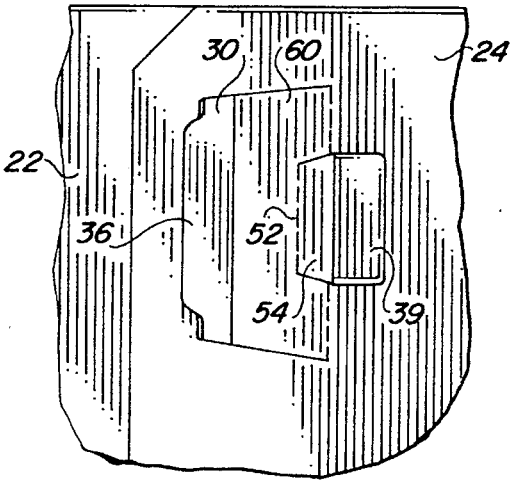
FIG. 11 is a partial plan view of the interior of the bottom panel of FIG. 10.

As illustrated in FIG. 7, the flap 60 is then folded back to its original position substantially in the same plane as the bottom panel flap 24. There is adequate room for this to take place since the tab 30 remains folded up to a point which allows this folding action of the flap 60. The final step in the locking process is to pivot the locking tab 30 down while also folding the outer tab portion 39 down about the fold line 38, and then pushing the outer tab portion 39 through the slit 48. A typical position of these elements during this phase of the folding process is illustrated in FIG. 8. As more clearly shown in FIG. 9, because the outer tab portion 39 does not move into the slit 48 at a right angle to the flap 60, the tab portion 39 contacts the small tab 54 of the flap 60 and pivots it slightly down into the interior of the carton. Although in the finished package the tab 54 may move back to a substantially parallel relationship with respect to the flap 60, the fold line 52 continuously biases the tab 54 against the outer tab portion 39 of the locking tab 30, thereby acting to prevent withdrawal of the tab portion 30 from the slit 48. By maintaining the secondary locking tab 30 securely in place, the engagement of the primary locking tab 36 beneath the primary locking edge 40 is also maintained, thereby locking the bottom panel flaps together. The final arrangement of the locks as they appear from the exterior of the carton is shown in FIG. 10. The final arrangement of the locks as they appear from the interior of the carton is shown in FIG. 11.

Although the panel locking process has been described in connection with the formation of an upright carton, it will be understood that the same principles would apply if the panel were formed with the carton inverted.

As previously stated, the invention makes it possible to tightly draw a wrap-around carrier blank around the articles to be packaged without having to employ timed finger elements, while at the same time providing effective primary and secondary locks for securely holding the panel flaps in place. Although continuous chains have been illustrated as representing a desirable method for pulling the flaps together in a packaging machine, it should be understood that other mechanical means may be designed for carrying out the same function.

It should also be understood that the invention is not limited to all the specific details described in connection with the preferred embodiment and that changes to certain features of the preferred embodiment which do not alter the overall basic function and concept of the invention may be made without departing from the spirit and scope of the invention defined in the appended claims.

What is claimed is:

1. In a carton including a panel formed from an outer flap which partially overlaps and is mechanically attached to an inner flap, the improvement comprising:

at least one locking tab connected to the outer flap by a fold line, the locking tab having a base portion and an outer portion;

a locking opening in the inner flap associated with the locking tab, the locking opening including a first edge adjacent the base tab portion and a second edge opposite the first edge;

a locking opening flap connected to the second edge of the locking opening by a fold line and at least partially covering the locking opening; and the inner flap including a secondary opening associated with the locking opening;

the base portion of the locking tab underlying the inner flap adjacent the first edge of the locking opening to form a primary lock and the outer portion of the locking tab extending through the secondary opening into the interior of the carton to form a secondary lock.

2. The carton improvement of claim 1, wherein the secondary opening in the inner flap is adjacent the locking opening flap fold line.

3. The carton improvement of claim 2, wherein the secondary opening in the inner flap interrupts the locking opening flap fold line.

4. The carton improvement of claim 2, wherein the locking opening flap incorporates a smaller tab, the smaller tab having a first edge connected to the locking opening flap along a fold line and a second edge contacting the outer portion of the locking tab.

5. The carton improvement of claim 2, wherein the outer portion of the locking tab is connected to the locking tab by a fold line.

6. A wrap-around carrier, comprising:

opposite side panels connected to a top panel and a bottom panel;

the bottom panel being comprised of an outer bottom panel flap connected to one of the side panels and an inner bottom panel flap connected to the opposite side panel, the outer bottom panel flap partially overlapping the inner bottom panel flap;

at least one locking tab connected to the outer bottom panel flap by a fold line, the locking tab having an outer portion and a base portion extending beyond the fold line;

a locking opening in the inner bottom panel flap associated with the locking tab, the locking opening including a first edge adjacent the base tab portion and a second edge opposite the first edge;

a locking opening flap connected to the second edge of the locking opening by a fold line and at least partially covering the locking opening; and the inner bottom panel flap including a secondary opening associated with the locking opening;

the base portion of the locking tab underlying the inner bottom panel flap adjacent the first edge of the locking opening to form a primary lock and the outer portion of the locking tab extending through the secondary opening into the interior of the carton to form a secondary lock.

7. The wrap-around carrier of claim 6, wherein the secondary opening in the inner bottom panel flap is adjacent the locking opening flap fold line.

8. The wrap-around carrier of claim 6, wherein the locking opening flap incorporates a smaller tab, the smaller tab having a first edge connected to the locking opening flap along a fold line and a second edge contacting the outer portion of the locking tab.

9. A blank for forming a wrap-around carrier, comprising:

a centrally located top panel section;

a side panel section connected to opposite edges of the top panel section;

an outer bottom panel flap connected to one of the side panel sections and an inner bottom panel flap connected to the other side panel section;

at least one locking tab connected to the outer bottom panel flap by a fold line, the locking tab having an outer portion and a base portion extending beyond the fold line;

a locking opening in the inner bottom panel flap, the locking opening including a first edge and a second edge inwardly spaced therefrom;

a locking opening flap connected to the second edge of the locking opening by a fold line and at least partially covering the locking opening; and the inner bottom panel flap including a secondary opening adjacent the locking opening flap fold line;

the base portion of the locking tab underlying the inner bottom panel flap adjacent the first edge of the locking opening in a carrier formed from the blank to form a primary lock and the outer portion of the locking tab extending through the secondary opening into the interior of such a carrier to form a secondary lock.

10. The wrap-around carrier blank of claim 9, wherein the secondary opening in the inner bottom panel flap interrupts the locking opening flap fold line.

11. The wrap-around carrier blank of claim 9, wherein the locking opening flap incorporates a smaller tab, the smaller tab having a first edge connected to the locking opening flap along a fold line substantially parallel to the locking opening flap fold line and an opposite second edge, said second edge contacting the outer portion of the locking tab in a carrier formed from the blank.

12. The wrap-around carrier blank of claim 9, wherein the outer portion of the locking tab is connected to the locking tab by a fold line.

13. A method of forming a mechanical lock in a carton formed from a blank having an outer flap at one end thereof and an inner flap at the opposite end thereof, the outer and inner flaps having opposite end edges, comprising:

providing at least one locking tab connected to and extending outwardly from the end edge of the outer flap by a fold line, the locking tab having a base portion and an outer portion;

providing a locking opening in the inner flap, the locking opening including a first edge spaced from and substantially parallel to the end edge of the inner flap, and a second edge opposite the first edge;

providing a locking opening flap connected to the second edge of the locking opening by a fold line, the locking opening flap at least partially covering the locking opening;

providing the inner flap with a secondary opening associated with the locking opening;

positioning the inner and outer flaps so that their end edges are closely spaced apart;

folding back the locking tab and the locking opening flap;

exerting a force against the folded back locking tab and an oppositely directed force against the folded back locking opening flap to move the connected inner and outer flaps into partially overlapping condition; and causing the base portion of the locking tab to underlie the inner flap adjacent the first edge of the locking opening to form a primary lock and the outer portion of the locking tab to extend through the secondary opening into the interior of the carton to form a secondary lock.

14. The method of claim 13, including the steps of incorporating a smaller tab in the locking opening flap, the smaller tab having a first edge connected to the locking opening flap along a fold line and an opposite second edge, and causing the outer portion of the locking tab to contact said opposite second edge.

15. The method of claim 13, wherein the outer portion of the locking tab is connected to the locking tab by a fold line.

* * * * *